US007954729B2

(12) United States Patent
Ricco et al.

(10) Patent No.: US 7,954,729 B2
(45) Date of Patent: Jun. 7, 2011

(54) METERING SERVOVALVE AND FUEL INJECTOR FOR AN INTERNAL COMBUSTION ENGINE

(75) Inventors: Mario Ricco, Casamassima (IT); Raffaele Ricco, Valenzano (IT); Sergio Stucchi, Valenzano (IT); Antonio Gravina, Valenzano (IT); Chiara Altamura, Valenzano (IT); Marcello Gargano, Valenzano (IT)

(73) Assignee: C.R.F. Societa Consortile per Aziono (IT)

( * ) Notice: Subject to any disclaimer, the term of this patent is extended or adjusted under 35 U.S.C. 154(b) by 147 days.

(21) Appl. No.: 12/023,766

(22) Filed: Jan. 31, 2008

(65) Prior Publication Data

US 2009/0032620 A1 Feb. 5, 2009

(30) Foreign Application Priority Data

Jul. 30, 2007 (EP) ..... 07425480

(51) Int. Cl.
*F02M 41/16* (2006.01)

(52) U.S. Cl. ..... 239/96; 239/585.1; 239/585.4

(58) Field of Classification Search ..... 239/96, 239/585.1–586
See application file for complete search history.

(56) References Cited

U.S. PATENT DOCUMENTS 7,299,998 B2 * 11/2007 Ricco et al. ..... 239/96
2006/0032950 A1 * 2/2006 Ricco et al. ..... 239/585.1
2006/0266846 A1 11/2006 Ricco et al.

FOREIGN PATENT DOCUMENTS

JP 9151826 6/1997

* cited by examiner

*Primary Examiner* — Christopher S Kim
(74) *Attorney, Agent, or Firm* — The Belles Group, P.C.

(57) ABSTRACT

A metering servovalve for a fuel injector of an internal combustion engine has an electro-actuator and a fixed valve body, which defines a control chamber communicating with an inlet and with an outlet channel. The outlet channel has at least one calibrated restriction and exits through the lateral surface of an axial stem, on which a sleeve slides, in a substantially fluid-tight manner, to open/close the outlet channel and so vary the pressure in the control chamber. The outlet channel is closed by an end portion of the sleeve that is elastically deformable in a radially outward direction, under the thrust of the fuel pressure, to increase the diameter at which the seal against the valve body is formed, with respect to a non-deformed state, and to generate an axial unbalancing force on the sleeve upon opening when the outlet channel is closed.

18 Claims, 3 Drawing Sheets

METERING SERVOVALVE AND FUEL INJECTOR FOR AN INTERNAL COMBUSTION ENGINE

CROSS REFERENCE TO RELATED PATENT APPLICATIONS

The present application claims priority under 35 U.S.C. §119 to European Patent Application No. 07425480.6, filed Jul. 30, 2007, the entirety of which is hereby incorporated by reference.

FIELD OF THE INVENTION

The present invention generally relates to fuel injectors for internal combustion engines, and specifically to fuel injectors for internal combustion engines having a balanced metering servovalve which controls an injection control rod.

BACKGROUND OF THE INVENTION

From patent EP1612403, it is known a fuel injector for an internal combustion engine comprising: a casing having a nozzle at one end for injecting filet into a cylinder of the engine, a movable needle for opening and closing the nozzle, a rod housed in the casing and sliding along its own axis to control movement of the needle, and a metering servovalve housed in the casing.

The metering servovalve comprises a control chamber, which communicates with a fuel inlet and with an outlet channel having a calibrated portion. The pressure in the control chamber controls the axial sliding of the rod, for the purpose of opening and closing the nozzle, and is adjusted by controlling an actuator comprising an electromagnet and a spring.

The actuator operates the translation of a sleeve between a closed position and an open position of the outlet channel. The sleeve is mounted so that it can slide in a substantially fluid-tight manner on an axial stem, which forms part of a fixed valve body with respect to the casing. The outer lateral surface of the axial stem defines an annular chamber into which the outlet channel exits. In the closed position, the sleeve closes the annular chamber in such a way as to be subjected to an axial fuel-pressure resultant that, at least in theory, is null.

In this system, where the metering servovalve and its sleeve are of the so-called "balanced" type, the preloading forces demanded of the actuator spring and the overall dimensions are reduced. In particular, even with small sleeve lifts, it is possible to obtain large fuel passage sections, with consequent advantages in the injector's dynamic behaviour, to reduce sleeve rebound phenomena at the end of opening and closing travel.

The inner diameter of the sleeve is greater than the outer diameter of the axial stem by an amount equal to a diameter clearance, which is preferably less than approximately 5 micron to ensure fluid tightness even without the use of proper gaskets.

It has been noted that the fluid seal between the sleeve and the valve body might not take place in correspondence to the inner diameter of the sleeve, but effectively in correspondence to a mean seal diameter that is larger, due to two phenomena: (1) in use, the sleeve tends to deform under the pressure; and (2) sealing does not take place along a circumference defined by a sharp edge (or null-radius bevel).

With regards to the first phenomenon, it is evident that the pressure of the fuel in the annular chamber reaches relatively high levels, around 1600-1800 bar for example, when the sleeve is in the closed position, while in the discharge area, or rather downstream of the sealing zone, pressure levels are relatively low, around a few bar. Therefore, the pressure in the annular chamber generates a radial force on the sleeve that is outwardly directed and that deforms the sleeve.

This deformation has the effect of "widening" the end of the sleeve and consequently increasing the diameter where contact and sealing on the valve body takes place, with respect to the inner diameter of the sleeve in the non-deformed state.

With regards to the second phenomenon, due to technological/constructional reasons, in practice the contact zone between the sleeve and the valve body is not exactly defined by a circumference, but by an annulus, even if of relatively small radial width. Sealing does not take place in correspondence to the inner diameter of this annulus, but in correspondence to a mean diameter, which is obviously greater than the inner diameter of the sleeve.

The increase in the diameter where sealing takes place with respect to the inner diameter of sleeve in the non-deformed state has the effect of creating an axial unbalancing force. which acts on the sleeve in the direction corresponding to its opening.

The magnitude of the axial unbalancing force depends on the fuel supply pressure and the annulus-shaped area defined by the difference between the diameter in which sealing effectively takes place and the minimum inner diameter of the sleeve at the opposite end.

In order to compensate for the axial balancing force, the actuator spring must have a greater preload force with respect to that theoretically determined by design with a perfectly balanced sleeve, from the axial pressure standpoint, to keep the sleeve closed.

On one hand, the spring's larger preload forces result in larger accelerations and aster impact speeds on closure against the valve body and, in consequence, greater risks of wear and damage to the metering servovalve.

On the other hand, the spring's larger preload forces result in greater risk of so-called "adhesive" wear between the surfaces of the sleeve and the valve body when they come into contact.

To limit the preload of the spring, known solutions have certain constructional expedients to eliminate the axial unbalancing force.

In particular, the sleeve and the valve body are made using materials with high hardness levels. In addition, the geometry and the material chosen for the end of the sleeve are such as to provide the sleeve with high rigidity, so as to practically eliminate elastic deformations.

Nevertheless, the geometry chosen to increase the rigidity results in an increase of the mass of the sleeve and therefore the amount of contact momentum with the valve body during closure. In consequence, the sleeve is subjected to undesired rebounding against the valve body during closure.

Due to these rebounds, on one hand, the metering servovalve does not close immediately, resulting in a greater quantity of fuel being injected into the cylinder than that determined by design.

On the other hand, in spite of choosing materials with high hardness levels, the rebounds cause relatively rapid wear on the circular edge of the sleeve that makes contact with the valve body during closure. This wear results in a progressive increase in the mean diameter at which the seal is created. and therefore an increase in the axial unbalancing force.

As the axial unbalancing force progressively increases, the behaviour of the metering servovalve and the injector as a whole progressively changes over time with respect to that determined by design: the change cannot. be predicted and therefore it cannot be compensated for in any way.

The consequences of this phenomenon are a rapid and significant increase in the flow of fuel recycled to the discharge and a shorter life for the injector.

SUMMARY OF THE INVENTION

The object of the present invention is that of providing a balanced metering servovalve for a filet injector of an internal combustion engine that allows the above-indicated problems to be resolved in a simple and economic manner.

According to the present invention, a metering servovalve for a fuel injector of an internal combustion engine is provided, the metering servovalve comprising: an electro-actuator, a fixed valve body, which defines a control chamber communicating with an inlet and with an outlet channel having at least one calibrated restriction and comprises a stem extending along an axis and having a lateral surface through which the said outlet channel exits, and a sleeve coupled to said lateral surface in a substantially fluid-tight manner and in a way that it can slide along said axis under the action of said electro-actuator between a closed position, in which an end portion of said sleeve closes the said outlet channel, and an open position in which said outlet channel is open, to vary the pressure in said control chamber, characterized in that said end portion has geometric characteristics such that it is elastically deformable in an radially outward direction under the thrust of the fuel pressure that, in use, is present at the mouth of said outlet channel, to increase the diameter at which sealing against said valve body takes place with respect to a non-deformed state, and generates an axial unbalancing force on said sleeve in the direction of the open position when said sleeve is in the closed position.

Preferably, said electro-actuator comprises a spring having a predefined preload to axially push said sleeve towards said closed position, and the geometry of said end portion is such that said axial unbalancing force exceeds the thrust of said preload when the supply pressure of said fuel exceeds a safety threshold.

In particular, the ratio between the outer and inner diameters of said end portion is preferably less than 2.4.

In another aspect, the invention can he a metering servovalve for a fuel injector of an internal combustion engine, the metering servovalve comprising: a fixed valve body having a control chamber communicating with an inlet channel and an outlet channel having at least one calibrated restriction; a stem extending along an axis and having a lateral surface, said outlet channel exiting at an opening in said lateral surface; a sleeve coupled to said lateral surface in a substantially fluid-tight manner that allows slidable movement along said axis between a closed position in which an end portion of said sleeve closes said opening and an open position in which said opening is open, thereby varying pressure in said control chamber; an electro-actuator operably coupled to said sleeve to facilitate said slidable movement; and said end portion having geometric characteristics that allow said end portion to elastically deform in a radially outward direction under a force of a fuel pressure at the opening to increase the diameter at which sealing against said valve body takes place with respect to a non-deformed state and generates an axial unbalancing force on said sleeve in the direction of the open position when said sleeve is in the closed position.

In yet another aspect, the invention can be a metering servovalve for a fuel injector of an internal combustion engine, the metering servovalve comprising: a body having a control chamber communicating with an inlet channel and an outlet channel; a stem extending along an axis and having a lateral surface, said outlet channel exiting at an opening in said lateral surface; a sleeve coupled to said lateral surface in a substantially fluid-tight manner that allows slidable movement of said sleeve along said axis between a closed position in which an end portion of said sleeve closes said opening and an open position in which said opening is open, thereby varying pressure in said control chamber:, an actuator operably coupled to said sleeve to facilitate said slidable movement; and said end portion being elastically deformable in a radially outward direction when subjected to an operating fuel pressure at the opening so as to generate an axial unbalancing force on said sleeve toward said open position when said sleeve is in said closed position.

In a still further aspect, the invention can be a fuel injector for an internal combustion engine comprising: an injector body extending along an axial direction; a nozzle to inject fuel into an associated cylinder of said internal combustion engine; a control rod axially movable in said injector body to control opening and/or closing of said nozzle; and a metering servovalve housed in said injector body to control said axial movement of said control rod, said metering servovalve comprising: a body having a control chamber communicating, with an inlet channel and an outlet channel; a stem extending along an axis and having a lateral surface, said outlet channel exiting at an opening in said lateral surface; a sleeve coupled to said lateral surface in a substantially fluid-tight manner that allows slidable movement of said sleeve along said axis between a closed position in which an end portion of said sleeve closes said opening and an open position in which said opening is open, thereby varying pressure in said control chamber; an actuator operably coupled to said sleeve to facilitate said slidable movement; and said end portion being elastically deformable in a radially outward direction when subjected to an operating fuel pressure at the opening so as to generate an axial unbalancing force on said sleeve toward said open position when said sleeve is in said closed position.

In a yet further aspect, the invention can he a metering servovalve for a fuel injector of an internal combustion engine, the metering servovalve comprising: an electro-actuator, a fixed valve body, which defines a control chamber communicating with an inlet and an outlet channel having at least one calibrated restriction and comprises a stein extending along an axis and having a lateral surface, through which said outlet channel exits, and a sleeve, coupled to said lateral surface in a substantially fluid-tight manner and in a way to slide along said axis under the action of said electro-actuator between as closed position, in which an end portion of said sleeve closes said outlet channel, and an open position, in which said outlet channel is open, to vary the pressure in said control chamber, characterized in that said end portion has geometric characteristics such that it is elastically deformable in an radially outward direction under the thrust of the fuel pressure that, in use, is present at the mouth of said outlet channel to increase the diameter at which sealing against said valve body takes place with respect to a non-deformed state and generates an axial unbalancing force on said sleeve in the direction of the open position when said sleeve is in the closed position.

BRIEF DESCRIPTION OF THE DRAWINGS

For a better understanding of the present invention, a preferred embodiment shall now be described, purely by way of non-limitative example, with reference to the attached drawings, in which.

DETAILED DESCRIPTION OF THE DRAWINGS

Figure 1:
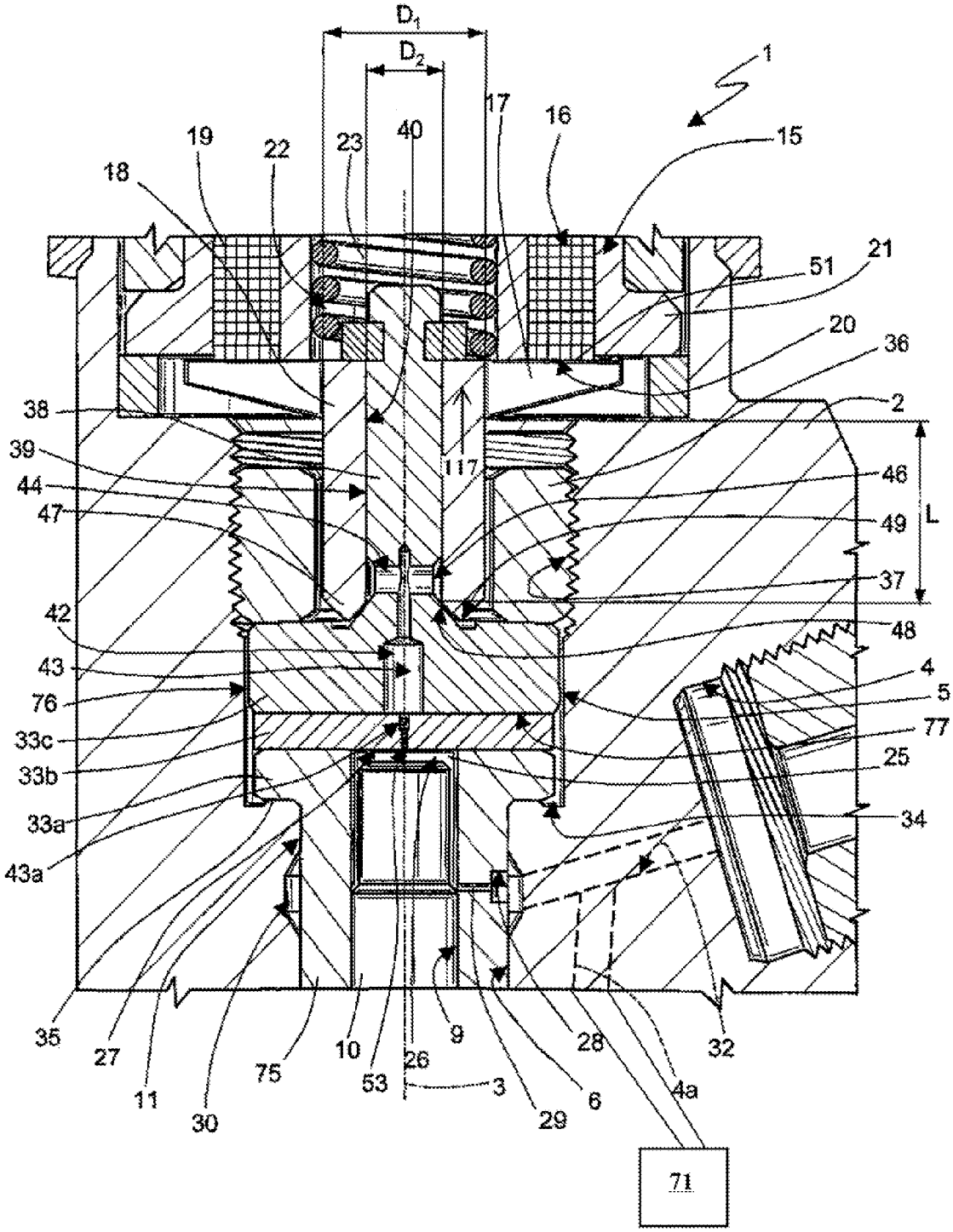
FIG. 1 shows, partially and in cross-section, a first embodiment of a balanced metering servovalve for a fuel injector of an internal combustion engine, according to the present invention.

With reference to FIG. 1, reference numeral 1 indicates, in its entirety, a fuel injector (partially shown) for an internal combustion engine, in particular a diesel-cycle one. The injector 1 comprises a hollow body or casing 2, commonly called the "injector body", which extends along a longitudinal axis 3, and has a side inlet 4 that can be connected to a high-pressure fuel supply line, at a pressure of around 1600 bar for example. The casing 2 terminates in an injection nozzle 71, which is in communication with the inlet 4, through a channel 4*a*, and is able to inject fuel into an associated cylinder of the engine.

The casing 2 defines an axial cavity 6 in which a metering servovalve 5 is housed and another cavity coaxial with cavity 6 and housing an actuator 15, which comprises an electromagnet 16 and a notched-disc armature 17 controlled by the electromagnet 16.

The armature 17 is fixed with respect to a sleeve. 18, which extends along axis 3. Whereas the electromagnet 16 comprises a magnetic core 19, which has a surface 20 perpendicular to axis 3 and defines an axial stop for the anchor armature 17, and is held in position by a support 21.

The actuator 15 has an axial cavity 22 housing a coil compression spring 23, which is preloaded to exert thrust on the armature 17 in the opposite axial direction to the attraction exerted by the electromagnet 16. The spring 23 has one end resting against an internal shoulder of the support 21 (not shown) and the other end acting on the armature 17.

The metering servovalve 5 comprises a valve body, made in three pieces: a tubular body 75 (partially shown), a disc 33*b* and a distribution and guide body 76.

Body 75 defines an axial through hole 9, in which a control rod 10 axially slides, in a fluid-tight manner, to control a shutter needle, in the known manner and not shown, which opens and closes the injection nozzle 71.

One axial end of the body 75 has an external flange 33*a* housed in a portion 34 of the cavity 6 of increased diameter and arranged in axial contact against a shoulder 35 inside the cavity 6.

One end of the hole 9 defines a control chamber 26, which is in permanent communication with the inlet 4, through a channel 28 made in the body 75, to receive pressed fuel. The channel 28 comprises a calibrated portion 29 and exits, with one end, into the control chamber 26 and, with the other end, into an annular chamber 30, defined by an outer cylindrical surface 11 of the body 75 and an annular groove on the inner surface of the cavity 6. A channel 32 made in body 2 and in communication with the inlet 4 exits into the annular chamber 30.

The control chamber 26 is axially delimited on one side by an end surface 25 of the rod 10, usefully having a truncated-cone shape and, on the other, by a bottom surface 27, which constitutes part of the face of the disc 33*b*.

The disc 33*b* is arranged in axial contact against the flange 33*a* on one side and against a surface 77 of body 76 on the other. The surface 77 axially delimits a base of the body 75 having an external flange 33*c*. The disc 33*b* is axially secured in a fixed and fluid-tight position between the flanges 33*a* and 33*c* via a threaded ring nut 36, which makes contact with the flange 33*c* and is screwed into an internal thread 37 of portion 34.

The body 76 also comprises a guide element for the a armature 17 and the sleeve 18. This element is defined by a substantially cylindrical stem 38 having a smaller diameter than that of the flange 33*c*.

The stem 38 projects beyond the base of body 76 along axis 3 in the opposite direction from disc 33*b* and body 75, i.e. towards the cavity 22. The stem 38 is externally delimited by a lateral cylindrical surface 39, which guides the axial sliding of the sleeve 18. In particular, the sleeve 18 has an internal cylindrical surface 40, coupled to the lateral surface 39 of the stem 38 in a substantially fluid-tight manner, i.e. via a coupling with opportune diameter clearance, less than 4 micron for example, or via the insertion of specific sealing elements.

The control chamber 26 is in permanent communication with a fuel outlet channel, indicated as a whole by reference numeral 42.

The channel 42 comprises an axial segment 43, which is made in the body 76 (partly in the flange 33*c* and partly in the stem 38) and, in turn, comprises an inlet 63 and a blind end 66 (FIG. 2), which has a smaller diameter than that of the inlet 63 and extends beyond the flange 33*c* into the stem 38.

The channel 42 also comprises an outlet segment 44, which is radial and exits, at one end, into the end 66 of segment 43 and, at the other end, into a chamber 46 defined by an annular groove in the lateral surface 39 of the stem 38.

In particular, two diametrically opposed segments 44 are provided.

According to that shown in FIG. 1, the chamber 46 is obtained in an axial position next to the flange 33*c* and is opened/closed by an end portion 47 of the sleeve 18, which defines a shutter for the channel 42. In particular, the portion 47 terminates with an internal truncated-cone surface united to the surface 40 via an edge 48, which is provided for resting against a truncated-cone connecting surface 49 between the flange 33*c* and the stem 38, to define a circular sealing zone.

The sleeve 18 slides on the stem 38, together with the armature 17, between an advanced end stop, or closed position, and a retracted end stop, or open position. In the advanced end stop position, the portion 47 closes the chamber 46 and thus the outlet of segments 44 of the channel 42. In the retracted end stop position, portion 47 sufficiently opens the chamber 46 to allow segments 44 to discharge the fuel in the control chamber 26 through channel 42 and chamber 46. The passage section tell open by portion 47 has a truncated-cone shape and is at least three times larger that the passage section of a single segment 44.

The advanced end stop position of the sleeve 18 is defined by the edge 48 hitting against the connection surface 49 between the flange 33 and the stem 38. Instead, the retracted end stop position of the sleeve 18 is defined by the armature 17 axially hitting against the surface 20 of the core 19, with a nonmagnetic gap sheet 51 inserted in between. In the retracted end stop position, the chamber 46 is placed in communication with a discharge channel of the infector (not shown) via an annular passage between the ring nut 36 and the sleeve 18, the notches In the armature 17, the cavity 22 and an opening in the support 21.

When the electromagnet 16 is energized, the armature 17, together with the sleeve 18, moves towards the core 19 and hence portion 47 opens the chamber 46. The fuel is then discharged from the control chamber 26: in this way, the fuel pressure in the control chamber 26 drops, causing an axial movement of the rod 10 towards the bottom surface 27 and thus the opening of the injection nozzle 71.

Conversely, on de-energizing the electromagnet 16, the spring 23 moves the armature 17, together with the sleeve 18, to the advanced end stop position. In this way, the chamber 46 is closed and the pressurized fuel entering from the channel 28 re-establishes high pressure in the control chamber 26, resulting in the rod 10 moving away from the bottom surface 27 and operating the closure of the injection nozzle 71, In the advanced end stop position, the fuel exerts an almost null axial thrust resultant on the sleeve 18, as the pressure in the chamber 46 only acts radially on the lateral surface. 40 of the sleeve 18.

In order to control the velocity of pressure variation in the control chamber 26 during the opening and closing the sleeve 18, channel 42 includes one or more calibrated restrictions. The term "restriction" is intended as a hole (or, more in general, a segment of the channel 42) with a smaller passage section than that which the fuel flow encounters upstream and downstream of this hole. Instead, the term "calibrated" is intended as the fact that the passage section is made with precision so as to precisely define a preset fluid outflow from the control chamber 26 and to cause a predetermined pressure drop from upstream to downstream.

In particular, for holes having relatively small diameters, calibration is achieved in a precise manner via a finishing operation of an experimental nature, which is carried out by making an abrasive liquid run through the previously made hole (for example, by electron discharge or laser), setting a pressure upstream and downstream of this and reading the flow rate passing through: the flow rate tends to progressively increase with the abrasion caused by the liquid on the lateral surface of the hole (hydro-erosion or hydro-abrasion), until a pre-established design value is reached. At this point, the flow is interrupted: in use, having a pressure upstream of the hole equal to that established during the finishing operation, the final passage section that is obtained defines a pressure drop equal to the difference in pressure established upstream and downstream of the hole during the finishing operation and a fuel flow rate equal to the predetermined design flow rate.

If more than one in number, these calibrated restrictions can be arranged in series with and/or in parallel to each other.

Figure 2:
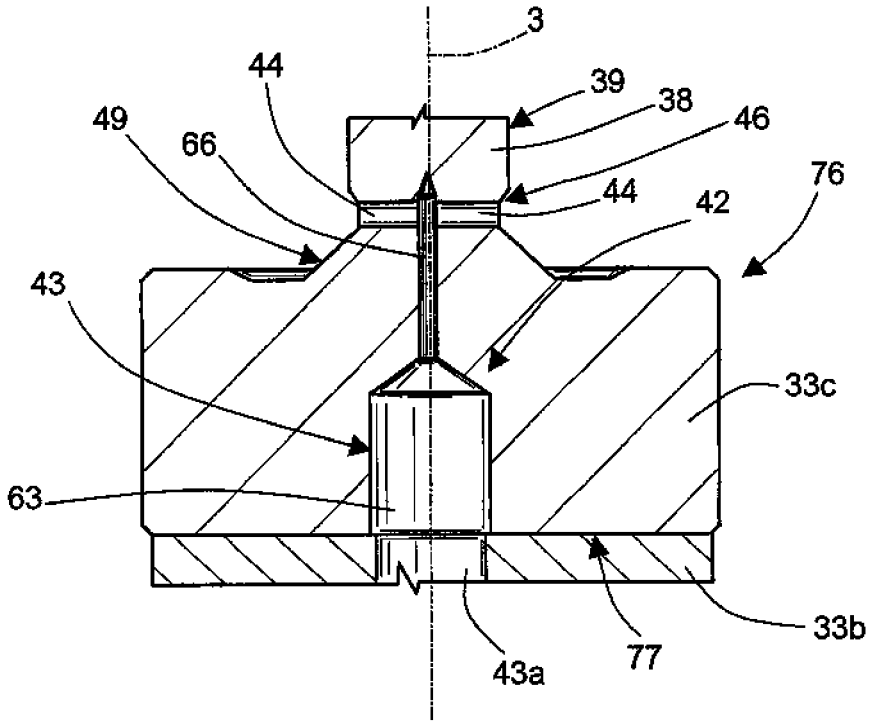
FIG. 2 shows detail of the valve body and stem of the balanced metering servovalve of FIG. 1.

With reference to the example shown in FIGS. 1 and 2, there are two restrictions arranged in series with each other along channel 42 (the diameter of the restrictions is only shown for completeness and is not in scale): one is defined by the blind end 66 of the segment 43 and the other is indicated by reference numeral 53 and is made axially in the disc 33*b*.

The calibrated restriction 53 axially extends for only part of the disc 33*b* and is in a position next to the control chamber 26, while the rest of the disc 33*b* has an axial segment 43*a* of larger diameter, of the same order of magnitude as that of the inlet 63 of segment 43.

Optionally, the disc 33*b* could be inverted, in this way having segment 43*a* exiting directly into the end of the hole 9, adding to the volume of the control chamber 26.

For example, the calibrated restriction 53 has a diameter between 150 and 300 micron. The diameter of the blind end 66 is greater than that of the calibrated restriction 53: for example, it can be approximately twice that of the calibrated restriction 53.

Since the diameter of blind end 66 is still relatively small, the diameter of the stem 38 and thus the diameter of the edge 48 where the seal is formed can be rested, for example, to a value between 2.5 and 3.5 mm, depending on the materials chosen and the type of heat treatment adopted.

The inlet 63 of segment 43 is obtained in body 76 via a normal drilling bit without special precision, to achieve a diameter that is at least four times greater than the diameter of the calibrated restrictions 53 and 66. Segments 44 also define a larger passage section than that of the blind end 66 and are obtained without special machining precision.

In use, the pressure drop that occurs between the control chamber 26 and the discharge zone when portion 47 is in the open position, is divided into as many pressure drops as there are calibrated restrictions arranged in series along the channel 42.

According to variants not shown, three calibrated restrictions are arranged in series, and/or the disc 33*b* is absent, and/or the disc 33*b* and the body 75 constitute part of an element made as a single piece, and/or one of the calibrated restrictions is made in an insert embedded in the inlet 63 of the body 76 or the disc 33*b*.

Figure 3:
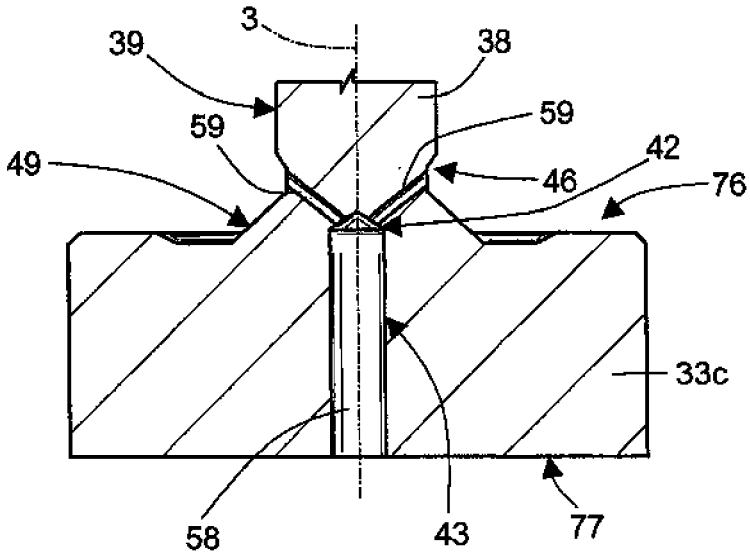
FIG. 3 is similar to FIG. 2 and illustrates a second embodiment of a metering servovalve according to the present invention.

According to the variant shown in FIG. 3, segment 43 comprises an axial segment 58 that substitutes the inlet 63 and the calibrated restriction 66 and has a constant diameter of the same order of magnitude as the inlet 63 and segment 43*a*. At the same time, the outlet segments 44 are substituted by inclined outlet segments 59, which define a calibrated restriction arranged in series with the calibrated restriction 53 and place the chamber 46 in direct communication with the bottom of segment 58. Preferably, segments 59 form an angle on inclination between 30° and 45° with respect to axis 3. In particular, by making segment 58 terminate before the beginning of the stem 38, the stem 38 proves to be relatively robust. Therefore, the diameter of the stem 38, and thus the diameter of the annular sealing zone between the sleeve 18 and the stem 38, defined by the edge 48, can be reduced in consequence, with obvious benefits in limiting leaks in this sealing zone under dynamic conditions. In particular, also with the expedient of making the outlet segments inclined, the diameter of the sealing zone (defined by the edge 48 in the non-deformed sate) can be kept at a value between 2.5 and 3.5 mm without the stem 38 appearing structurally weak.

In this variant, segment 58 usefully has a diameter between 8 and 20 times that of the calibrated restriction 53, in order to facilitate the intersection of the inclined outlet segments 59 with the bottom of segment 58 during manufacture.

According to the invention, the geometry of the shutter defined by the portion 47 of the sleeve 18 is such as to render the portion 47 elastically deformable and not rigid as in the known art.

In particular, the ratio between the outer diameter D1 and the inner diameter D2 of portion 47 in the non-deformed state is less than 2.2, Furthermore, the ratio between the axial length L and the inner diameter D2 of portion 47 is greater than 1.8. The axial length L is intended as running from the edge 48 in which the seal is formed up to a position in which an abrupt change in the outer diameter of the sleeve 18 is encountered: for example, in the solution in FIG. 1, this abrupt change occurs right at the end of the sleeve 18, i.e. in correspondence to the armature 17.

Preferably, the ratio between the outer diameter D1 of the sleeve 18 and the inner diameter D2 is greater than 1.7 and/or the ratio between the axial length L of the sleeve 18 and the inner diameter D2 is less than 3, in order to avoid deformation and/or excessive weakening of the sleeve 18.

Figure 4:
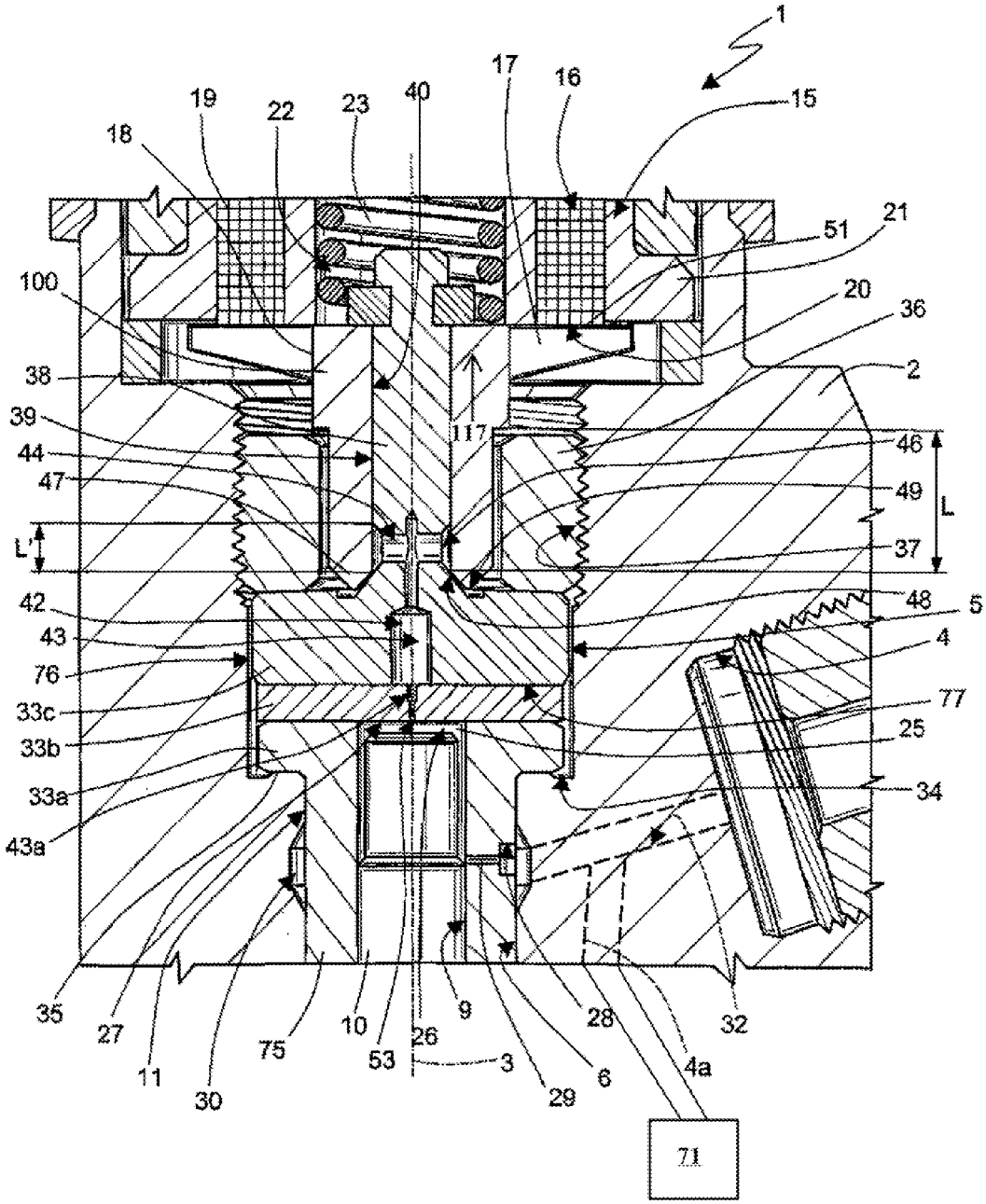
FIG. 4 shows, partially and in cross-section, a third embodiment of a balanced metering servovalve for a fuel injector of an internal combustion engine, according to the present invention.

In the variant in FIG. 4, the sleeve 18 comprises an end portion 100, at the opposite end to portion 47, with an outer diameter greater than the outer diameter D1. In particular, an abrupt enlargement defined by an annular shoulder orthogonal to axis 3 is provided between portions 47 and 100.

In this way, portion 100 has greater rigidity with respect to that of portion 47, tier which the elastic deformation is concentrated on portion 47 itself, while portion 100, remaining substantially undeformed, is able to assure the fluid seal between surfaces 39 and 40 in position next to the armature 17 without the need to add gasket elements.

In this case, the geometry of portion 47 is defined as follows: the ratio between the outer diameter D1 of portion 47 and the inner diameter D2 is greater than 1.6 and less than 2.4, and the ratio between the axial length L of portion 47 and the inner diameter D2 is greater than 0.45 and less than 0.8 (where "axial length L" is still intended as the axial length measured from the edge 48 up to a position in which there is an abrupt change in the outer diameter of the sleeve 18, i.e. in correspondence to the shoulder at the beginning of portion 100). Furthermore, in this variant in FIG. 4, defining the axial length of the chamber 46 as L', measured from the edge 48, and defining $L-L'=\Delta L$, gives $\Delta L$ greater than 0.2 and less than 0.8 millimeters.

Choosing the above-indicated dimensional ratios results in a reduction in the rigidity of portion 47 and the mass of the sleeve 18 with respect to the known art.

In other words, a geometry is expressly sought that lets portion 47 of the sleeve 18 elastically deform in a radially outward direction under the effect of the pressure in the chamber 46 when the sleeve 18 is in the closed position.

Thanks to the elastic deformation, the edge 48 is more external with respect to the non-deformed state, for which the seal between portion 47 and surface 49 occurs in correspondence to a mean diameter greater than the theoretical one of the non-deformed state.

The main effect resides in converting most of the kinetic energy of the sleeve 18 into elastic deformation, at the moment of impact of portion 47 against surface 49. This conversion of kinetic energy into elastic deformation energy has the advantage of a significant reduction in rebound phenomena.

In fact, after being elastically deformed during impact against body 76, portion 47 tends to release the accumulated elastic energy to return to the non-deformed state. The deformation energy tends to be transformed back into kinetic energy, but the times of this reconversion are relatively long, in particular with respect to known art in which the sleeve 18 is rigid.

Furthermore, the choice made regarding the above-indicated dimensional ratios allows the effects of so-called "adhesive" wear to be reduced as during contact, portion 47 tends to slightly slip on the conical surface 49 (in a radial direction) rather than "sticking" on it.

Moreover, even if the slippage of portion 47 on surface 49 results in a temporary increase in the mean diameter in which the seal is effectively formed, it introduces an energy damping effect that tends to further reduce rebound phenomena.

In addition, the slippage of portion 47 on surface 49 reduces possible phenomena of micro-fractures and/or surface micro-welds, which instead tend to be favoured by high specific loads acting on the edge 48 of portion 47.

To further improve the slippage of portion 47 on surface 49, it is opportune to choose materials and/or surface treatments for the body 76 and the sleeve 18 that reduce the coefficient of friction.

Furthermore, it is possible to exploit the axial unbalancing three 117 generated by the elasticity of portion 47 to make the metering servovalve 5 also operate as a safety valve. In fact, the geometry of portion 47 can be determined in a way to have an axial unbalancing force 117 that exceeds the preload thrust of the spring 23 when the fuel supply pressure exceeds a safety threshold, for example, to threshold of 2500 bar. In practice, if the supply pressure exceeds the safety threshold while the sleeve 18 is in the closed position, the axial unbalancing force 117 overcomes the preload of the spring 23 and causes the automatic opening of the metering servovalve 5 to discharge part of the fuel from the control chamber 26 through channel 42 and the chamber 46 without operating the movement of the rod 10, thereby ensuring that peak pressure does not damage the components of the injector 1.

From that shown above, it is evident that the behaviour over time of the metering servovalve 5 and the injector 1 can be estimated with greater precision and reliability with respect to the known art as, thanks to the reduction in so-called "adhesive" wear and wear due to impacts and rebounds, the diameter at which the seal effectively forms has less drift over time with respect to known solutions in which the sleeve 18 is rigid.

Even if an axial unbalancing force 117 intended to move the sleeve 18 to an open position is present, by reducing, wear, this force tends to remain almost constant over time and is predictable at the design stage.

In addition, the reduction in the diameter of the stem 38 below 3.5 mm, and thus the reduction in the seal diameter of portion 47, allows reductions in leakage under dynamic conditions and the preload required for the spring 23, and thus the force required from the actuator 15. The choice of a diameter value below 3.5 mm for the stem 38 is made in function of the material chosen for the valve body, the heat treatment to which the valve body is subjected and consequently its toughness and, lastly, the machining cycle adopted.

The reduction in seal diameter of portion 47 provides the possibility of also reducing the axial length of the sleeve 18 and therefore to reduce its mass even further. In fact, the flow rate of fluid leakage between the surfaces 39 and 40 is directly proportional to the length of their circumference in the coupling zone, but inversely proportional to the axial length of this coupling zone: by decreasing the diameter, and thus the length of said circumference, and accepting the same fluid leakage flow rate that a stem with a larger diameter gave, it is possible to reduce the axial length of the coupling zone and, consequently, reduce the mass and overall dimensions. Obviously, the reduction in mass of the sleeve 18 implies a reduction in the response times of the metering servovalve 5.

Furthermore, the reduction in the outer diameter of the stem 38, and thus the length of seal circumference along the edge 48, reduces the magnitude of the axial unbalancing force 117 and therefore allows the preload force of the spring 23 to be reduced, which must still be provided to compensate the radial axial unbalancing force 117 due to the elastic deformation of portion 47.

The ratio between the preload force of the spring 23 and the diameter of the edge 48 is usefully between 10 and 15 [N/mm].

In addition to the elasticity of portion 47, the reduction in mass of the sleeve 18 also has the effect of reducing rebound phenomena in the closure phase, and therefore better operating precision of the metering servovalve 5.

Finally, it is clear that modifications and its can be made regarding the metering servovalve 5 described herein without leaving the scope of protection of the present invention, as defined in the attached claims.

In particular, the actuator 15 could be substituted by a piezoelectric actuator that, when subjected to an electric current, increases its axial dimension to operate the sleeve 18 in order to open the outlet of the channel 42.

Moreover, the chamber 46 could be at least partially excavated in surface 40 and/or the channel 42 could be asymmetric with respect to axis 3: for example, segments 44 and 59 could have different cross sections from one another, and/or different diameters from one another, and/or have axes lying on the different planes from one another, and/or not all be equally spaced out around the axis 3.

In addition, the valve body could be made in two pieces or in a single piece, instead of three pieces, and/or the armature 17 and the sleeve 18 could be defined by separate elements and arranged in contact against one another, instead of being integrated in a single body.

What is claimed is:

1. A metering servovalve for a fuel injector of an internal combustion engine, the metering servovalve comprising:

a fixed valve body having a control chamber communicating with an inlet channel and an outlet channel having at least one calibrated restriction;

a stem extending along an axis and having a lateral surface, said outlet channel exiting at an opening in said lateral surface;

a sleeve coupled to said lateral surface in a substantially fluid-tight manner that allows slidable movement along said axis between a closed position in which a first end portion of said sleeve closes said opening and an open position in which said opening is open, thereby varying pressure in said control chamber;

said sleeve comprising an armature at a second end portion of said sleeve that is axially opposite said first end portion and an annular shoulder such that an outer diameter of said second end portion is greater than an outer diameter of said first end portion, said annular shoulder located axially between said first end portion and said armature;

an electro-actuator operably coupled to said sleeve to facilitate said slidable movement; and said first end portion having geometric characteristics that allow said first end portion to elastically deform in a radially outward direction under a force of a fuel pressure at said opening to generate an axial unbalancing force on said sleeve in a direction of the open position when said sleeve is in the closed position.

2. The metering servovalve of claim 1 wherein said electro-actuator comprises a spring having a predefined preload that exerts a thrust force that axially pushes said sleeve towards said closed position, and wherein said geometric characteristics of said first end portion are such that said axial unbalancing force exceeds said thrust force when said supply pressure of said fuel exceeds a safety threshold.

3. The metering servovalve of claim 2 wherein the ratio between said thrust force of said spring and an inner diameter of said first end portion in the non-deformed state is between 10 and 15 N/mm.

4. The metering servovalve of claim 2 wherein said safety threshold is equal to approximately 2500 bar.

5. The metering servovalve of claim 1 wherein a ratio between said outer diameter of said first end portion and an inner diameter of said first end portion is less than 2.4.

6. The metering servovalve of claim 5 wherein said ratio between said outer diameter of said first end portion and said inner diameter of said first end portion is less than 2.2.

7. The metering servovalve of claim 5 wherein said ratio between said outer diameter of said first end portion and said inner diameter of said first end portion of said sleeve is greater than 1.6.

8. The metering servovalve of claim 1 wherein a ratio between an axial length of said first end portion and an inner diameter of said sleeve is greater than 1.8, said axial length being measured from an edge of said first end portion that contacts said valve body to said annular shoulder of said second end portion when in said closed position.

9. The metering servovalve of claim 8 wherein said ratio between said axial length of said first end portion and said inner diameter of said sleeve is less than 3.

10. The metering servovalve of claim 1 wherein said axial stem has an outer diameter of less than 3.5 millimeters.

11. The metering servovalve of claim 10 wherein said outer diameter of said axial stem is equal to approximately 2.5 millimeters.

12. The metering servovalve of claim 1 wherein said first end portion is elastically deformed in a radially outward direction and said second end portion remains substantially undeformed so as to maintain a fuel seal between said stem and said second end portion.

13. The metering servovalve of claim 1 wherein a ratio between a first axial length and an inner diameter of said first end portion is greater than 0.45, said first axial length being measured from an edge of said first end portion which contacts said valve body up to said annular shoulder.

14. The metering servovalve of claim 13 wherein said ratio between said first axial length and said inner diameter of said first end portion is less than 0.8.

15. The metering servovalve of claim 1 wherein said outlet channel terminates in an annular chamber of said axial stem, said annular chamber having a second axial length, said second axial length being measured from an edge of said first end portion of said sleeve which contacts said valve body up to a distal end of said annular chamber, said second axial length being less than a first axial length by an amount of between 0.2 and 0.8 millimeters, said first axial length being measured from an edge of said first end portion which contacts said valve body up to said annular shoulder.

16. A metering servovalve for a fuel injector of an internal combustion engine, the metering servovalve comprising:

a body having a control chamber communicating with an inlet channel and an outlet channel;

a stem extending along an axis and having a lateral surface, said outlet channel exiting at an opening in said lateral surface;

a sleeve coupled to said lateral surface in a substantially fluid-tight manner that allows slidable movement of said sleeve along said axis between a closed position in which a first end portion of said sleeve closes said opening and an open position in which said opening is open, thereby varying pressure in said control chamber, wherein said first end portion comprises a truncated cone surface;

said sleeve comprising an armature at a second end portion of said sleeve that is axially opposite said first end portion and an annular shoulder such that an outer diameter of said second end portion is greater than an outer diameter of said first end portion, said annular shoulder located axially between said truncated cone surface and said armature;

an actuator operably coupled to said sleeve to facilitate said slidable movement; and said first end portion being elastically deformable in a radially outward direction when subjected to an operating fuel pressure at said opening so as to generate an axial unbalancing force on said sleeve toward said open position when said sleeve is in said closed position.

17. The metering servovalve of claim 16 wherein said actuator comprises a spring having a predefined preload that exerts a thrust force that pushes said sleeve towards said closed position, and wherein said axial unbalancing force on said sleeve exceeds said thrust force when said supply pressure of said fuel exceeds a safety threshold.

18. A fuel injector for an internal combustion engine comprising:

an injector body extending along an axial direction;

a nozzle to inject fuel into an associated cylinder of said internal combustion engine;

a control rod axially movable in said injector body to control opening and/or closing of said nozzle; and a metering servovalve housed in said injector body to control said axial movement of said control rod, said metering servovalve comprising:

a body having a control chamber communicating with an inlet channel and an outlet channel;

a stem extending along an axis and having a lateral surface, said outlet channel exiting at an opening in said lateral surface;

a sleeve coupled to said lateral surface in a substantially fluid-tight manner that allows slidable movement of said sleeve along said axis between a closed position in which a first end portion of said sleeve closes said opening and an open position in which said opening is open, thereby varying pressure in said control chamber, wherein said first end portion comprises a truncated cone surface;

said sleeve comprising an armature at a second end portion of said sleeve that is axially opposite said first end portion and an annular shoulder orthogonal to said axis such that an outer diameter of said second end portion is greater than an outer diameter of said first end portion, said armature forming a flange, and said annular shoulder located axially between said truncated cone surface and said flange;

an actuator operably coupled to said sleeve to facilitate said slidable movement: and said first end portion being elastically deformable in a radially outward direction when subjected to an operating fuel pressure at said opening so as to generate a an axial unbalancing force on said sleeve toward said open position when said sleeve is in said closed position.

* * * * *

UNITED STATES PATENT AND TRADEMARK OFFICE

CERTIFICATE OF CORRECTION

PATENT NO. : 7,954,729 B2
APPLICATION NO. : 12/023766
DATED : June 7, 2011
INVENTOR(S) : Mario Ricco et al.

It is certified that error appears in the above-identified patent and that said Letters Patent is hereby corrected as shown below:

ON THE TITLE PAGE

On the Face Page, under the Assignee Section, item (73) amend the Assignee Name as follows:

C.R.F. Società Consortile per Azioni

Signed and Sealed this
Twentieth Day of March, 2012

David J. Kappos

David J. Kappos
*Director of the United States Patent and Trademark Office*